United States Patent [19]

Mucha

[11] Patent Number: 4,517,765

[45] Date of Patent: May 21, 1985

[54] REMOTELY CONTROLLABLE VENT DOOR

[75] Inventor: Basil Mucha, Fairless Hills, Pa.

[73] Assignee: Teleflex Incorporated, Limerick, Pa.

[21] Appl. No.: 423,794

[22] Filed: Sep. 27, 1982

[51] Int. Cl.[3] ..... E05F 15/20

[52] U.S. Cl. ..... 49/3; 49/4; 49/8; 49/379

[58] Field of Search ..... 49/357, 325, 300–302, 49/395, 1, 2, 3, 7, 8; 52/1, 199, 200; 74/501

[56] References Cited

U.S. PATENT DOCUMENTS

| | | | |
|---|---|---|---|
| 1,500,678 | 7/1924 | Konsalik | 52/1 |
| 3,251,158 | 5/1966 | Shapiro | 49/7 X |
| 3,601,437 | 8/1971 | Lyons | 49/7 X |
| 3,830,016 | 8/1974 | Levine | 49/8 |
| 4,090,437 | 5/1978 | Bogaert | 49/1 X |
| 4,186,524 | 2/1980 | Pelchat | 49/357 X |
| 4,412,458 | 11/1983 | Derringer | 74/501 X |

FOREIGN PATENT DOCUMENTS

| | | | |
|---|---|---|---|
| 150076 | 7/1951 | Australia | 49/325 |

*Primary Examiner*—Kenneth Downey

*Attorney, Agent, or Firm*—Harold W. Milton, Jr.

[57] ABSTRACT

A motion transmitting remote control assembly of the type for transmitting motion in a curved path to open from a remote location at least one vent door which is held in a closed position by latches which engage the door, the assembly including core elements for transmitting linear motion along a curved path and an actuator for actuating the linear motion of the core elements. Conduits guide the path of the core elements. The core elements include a portion extending from the conduits and adapted to be operatively connected to the latches of the vent door whereby operation of the actuator actuates linear motion of the core elements to disengage the latches from the vent door.

25 Claims, 5 Drawing Figures

REMOTELY CONTROLLABLE VENT DOOR

BACKGROUND OF THE INVENTION

1. Technical Field

This invention relates to a motion transmitting remote control assembly of the type for transmitting motion in a curved path. More specifically, the instant invention relates to a push/pull assembly for operating a door, such as a vent door positioned on a roof of a warehouse or other type of large building, wherein the manually operable control is located at a remote position, preferably exteriorally of the building.

2. Background Art

In large buildings such as warehouses or factories where the possibility of a fire or explosion exists, it is desirable to have vent doors or skylights in the roof. The vents are operable to allow for the escape of heat and gasses emanating from a fire or explosion. These vents generally have a heat sensitive latch which releases when the ambient temperature within the building rises above a predetermined level, such as during a fire. An example of such a prior art vent door assembly is disclosed in the U.S. Pat. No. 3,251,158 to Shapiro. The Shapiro patent further discloses a ring which would be accessable from the roof of the building to actuate the vent doors to open manually. The U.S. Pat. No. 3,516,197 to Lyons also discloses a manually operable means located at a remote position from the vent door which is operably connected by a cable to the vent door so that the vent door may be manually opened. However, neither prior art patent teaches a remote control assembly which is operably connected to a latch means which opens the vent doors, nor does any prior art patent disclose a single push/pull action mount for opening the vent doors.

STATEMENT OF THE INVENTION

According to the present invention, there is provided a motion transmitting remote control assembly of the type for transmitting motion in a curved path to open from a remote location at least one vent door which is held in a closed position by latch means engaging the door. The assembly includes cable means for transmitting linear motion along a curved path, actuator means for actuating linear motion of the cable means, and guide means for guiding the path of the cable means. The cable means includes a portion extending from the guide means and adapted to be operatively connected to the latch means whereby operation of the actuator means acuates linear motion of the cable means to disengage the latch means from the vent door.

By utilization of the instant invention, a more efficient and effective means is provided for opening and closing a vent door from a remote location.

FIGURES IN DRAWINGS

Other advantages of the present invention will be readily appreciated as the same becomes better understood by reference to the following detailed detailed description when considered in connection with the accompanying drawings wherein.

DETAILED DESCRIPTION OF THE DRAWINGS

Figure 1:
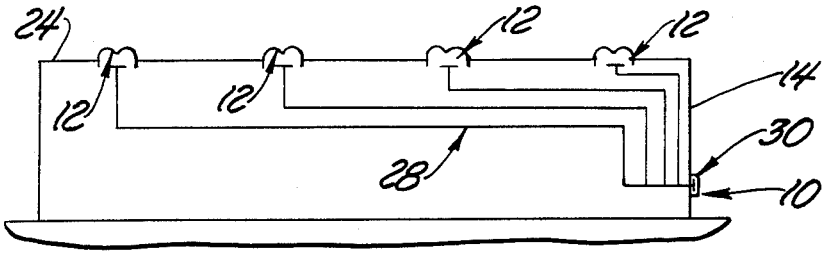
FIG. 1 is a schematic elevational view of a building including a motion transmitting remote control assembly constructed in accordance with the instant invention.

A motion transmitting remote control assembly of the type for transmitting motion in a curved path constructed in accordance with the instant invention is generally shown at 10. The assembly 10 is of the type for transmitting motion in a curved path to open from a remote location vent doors generally indicated at 12 located on the roof of a building 14, such as a manufacturing plant or warehouse as schematically shown in FIG. 1. The vent doors 12 are opened for the purpose of venting smoke in the event of a fire or explosion.

Figure 2:
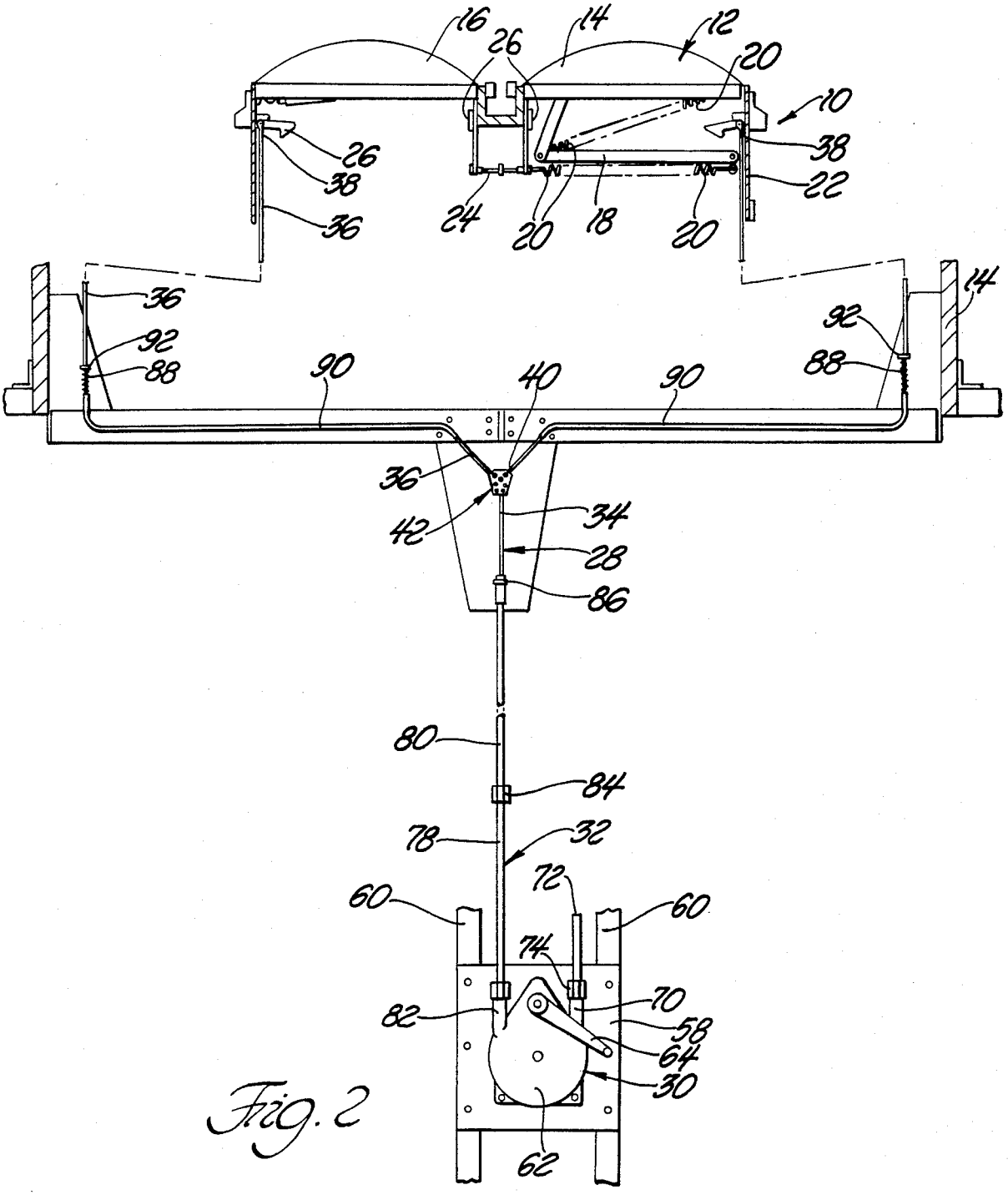
FIG. 2 is an elevational view, partially in cross-section, of a motion transmitting remote control assembly constructed in accordance with the instant invention.

Referring to FIG. 2, the vent doors illustrated are of the type shown in the U.S. Pat. No. 3,251,158 to Shapiro. The vent doors 12 include a plexiglass dome 16 which is normally latched in a closed position. A combination of links 18 and springs 20 interconnect the door 16 to its housing 22. The housing 22 is supported on the roof 24 of the building 14. Generally, the vent door 16 is operable to automatically open in the event of heat within the building 14 exceeding some predetermined level. Two vent doors 16 are mounted in a single assembly and are retained in a closed position by fuse link 24, fuse link 24 being sensitive to heat. Fuse link 24 is operably connected by the springs 20 and links 18 to latches 26. The latches 26 retain the door 16 in a closed position. If the heat within the building 14 becomes too great, the fuse link 24 is broken, causing the latches 26 to move to an unlatched position so as to allow the springs 20 and links 18 to automatically pivot the vent doors 16 to an open position to vent the interior of the building 14. Alternatively, other vent door constructions, such as leaf-type vents may be used.

As disclosed in the Shapiro patent, means are normally provided for manually disengaging the latches 26 to open the vent doors 16 independently of the fuse link 24. However, in most modern installations, the vent doors 16 are mounted on roofs which are many stories high and, when a fire breaks out, it is extremely difficult for someone to climb the many stories to actuate the manual release prior to triggering the fuse link 24. It is often desirable to open the vent doors 16 prior to the heat in the building reaching the predetermined level for breaking the fuse link 24.

The instant invention solves the above mentioned problem by providing a motion transmitting remote control assembly 10 which may be disposed exteriorally of the building 14, as shown schematically in FIG. 1.

The assembly 10 includes cable means indicated generally at 28 for transmitting linear motion along a curved path and actuator means indicated generally at 30 for actuating linear motion of the cable means 28. The assembly 10 further includes guide means indicated generally at 32 for guiding the path of the cable means 28, the cable means 28 including a portion extending from the guide means 32 and being adapted to be operatively connected to the latches 26 whereby operation of the actuator means 30 actuates linear motion of the cable means 28 to disengage the latches 26 from the vent doors 16. In other words, the instant invention provides a manually operable means, preferably located exteriorally of the building 14, whereby the vent doors 16 may be opened in the event of a minor fire to vent smoke and heat from the interior of the building 14 before the heat triggers the operation of an automatic sprinkler system, which would cause unnecessary damage to the contents of the building. Unlike prior art constructions, the instant invention provides a push-/pull assembly 10 which can be located at a remote location relative to the vent door assembly 12 for efficient and effective operation of the vent door assembly 12.

Figure 3:
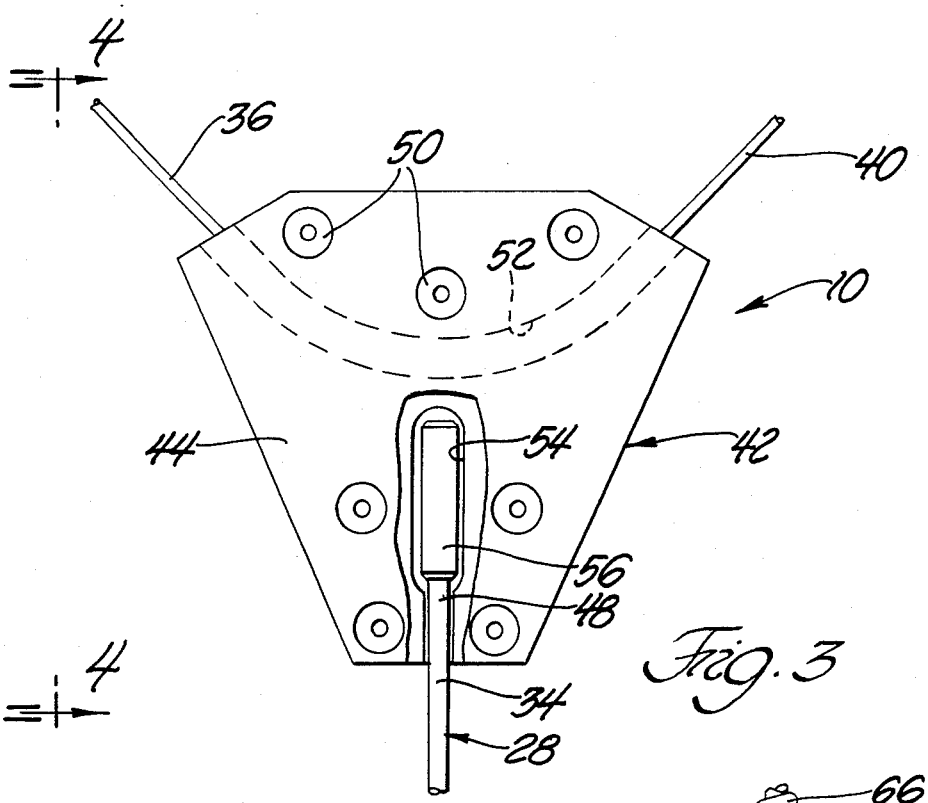
FIG. 3 is an enlarged view, partially broken away, of the cable coupler of the instant invention.
Figure 4:
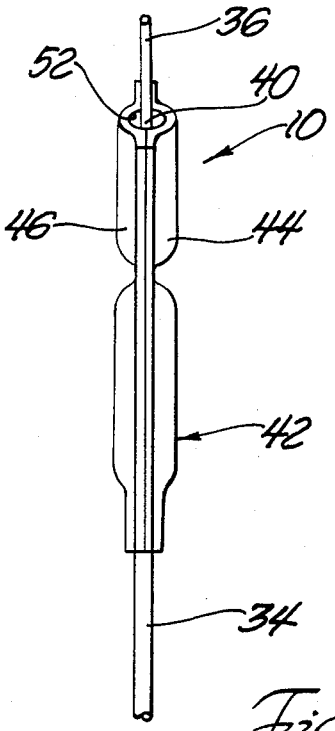
FIG. 4 is a side view taken substantially along line 4—4 of FIG. 3.

More specifically, the cable means 28 includes a first cable 34 extending from the actuator means 30 and through the guide means 32. The cable means 28 further includes a second cable 36 having two end portions 38 and an intermediate portion 40 therebetween. Each end portion 38 of the second cable 36 is adapted to be connected to a respective one of the pair of latches 26 engaging the pair of adjacent vent doors 16 in a closed position. The assembly 10 includes coupling means generally indicated at 42 for coupling the first cable 34 to the intermediate portion 40 of the second cable 36. In other words, the two end portions 38 of the second cable 36 are operatively connected to the latches 26 which maintain the vent doors 16 in a closed position. The coupling means 42 interconnects the first cable 34 extending from the actuator means 30 to an intermediate portion 40 of the second cable 36 thereby providing a single pull action mount. The coupling means 42 includes first and second plate members 44 and 46 secured together to clamp an end portion 48 of the first cable 34 therebetween, as shown in FIG. 3. The plates 44 and 46 have an arcuate ridge therein which, when the plates 44 and 46 are connected together by rivets 50 or other connecting means, form a passageway 52 therethrough. The intermediate portion 40 of the second cable 36 is disposed within the passsageway 52. The connected plates 44 and 46 further form a second passageway 54, the end portion 48 of the first cable 34 being secured therein. A slug 56 is fixedly secured to the end portion 48 of the first cable 34, the slug 56 being retained in the passageway 54. In this way, the coupling means 42 translates the linear motion of a single cable 34 to the two end portions 38 of the second cable 36 to actuate two latches 26 from a single actuator means 30.

The first and second cables 34 and 36 have a neutral position when the vent doors 16 are in the closed position, and an actuated position for releasing the latches 26 wherein a terminal portion of the first cable 34 is drawn into the actuator means 30. More specifically, the actuator means is of the type disclosed in U.S. Pat. No. 3,766,801 to Weigand. As shown in FIG. 2 2, the actuator means 30 is mounted on a mounting plate 58, the mounting plate 58 being fixedly secured to beams 60 of the building structure. The actuator means 30 includes a housing 62 mounted on the plate 58. The actuator means 30 generally includes a manually rotatable input shaft driven by the crank arm 64, the input shaft carrying a pinion gear which drives an internal ring gear which, in turn, drives the cable 34. Thus, the terminal end of the first cable 34 is reciprocated as the shaft is rotated by the crank arm 64. Other means may be used for mechanically reciprocating the terminal end of the first cable 34 whereby rotary motion of the actuator means 30 via the crank arm 64 is translated into linear motion of the first cable 34.

Figure 5:
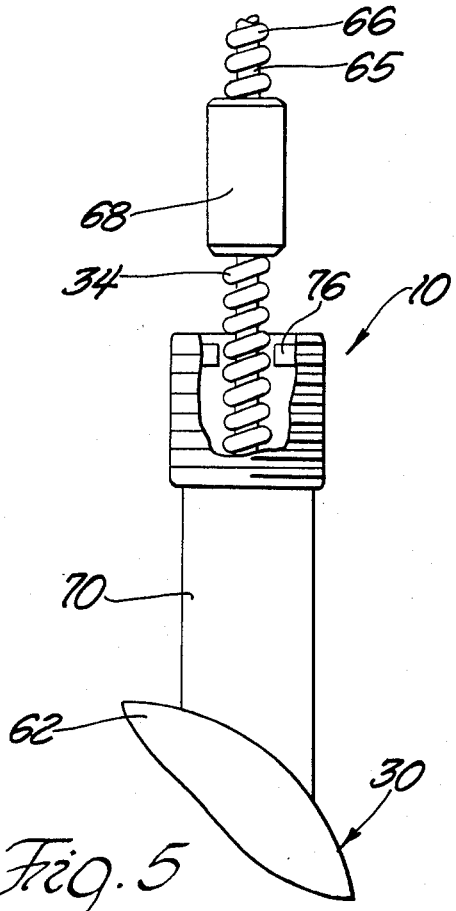
FIG. 5 is a fragmentary elevational view of the cable stop means of the instant invention.

The terminal end 65 of the first cable 34 includes a core element having a helical wire 66 wound thereabout engaging the grooves of the driving gear within the actuator means 30 whereby rotary motion of the crank arm 64 is translated into linear motion of the first cable 34. The terminal portion 65 of the first cable 34 further includes stop means for preventing the terminal portion 65 from being completely fed through the drive gear of the actuator means 30 as the cable means 28 is actuated to the neutral position. The stop means includes a slug 68 fixedly secured to the terminal portion 65 of the first cable 34 as shown in FIG. 5. The housing 64 includes a spigot 70 extending upwardly therefom having a tube member 72 connected thereto by a bolt member 74. As shown in FIG. 5, the spigot 70 includes abutments 76 extending inwardly into the spigot 70 for engaging the slug 68 to prevent the slug 68 and terminal portion 65 of the first cable 34 from entering the housing 62 and being fed through the actuator means 30. The tubular extension 72 allows the terminal portion 65 to enter into the tubular extension 72 when the first and second cables 34 and 36 are actuated to the actuated position wherein the terminal portion 64 of the first cable 34 is drawn through the actuator means 30.

The guide means 32 includes a first and second conduit 78 and 80, respectively, the first conduit 78 having one end portion connected to a second spigot 82 extending upwardly from the housing 62 of the actuator means 30. The first cable 34 extends from the actuator means 30 through the first and second conduits 78 and 80 and out the end of the second conduit 80. A nut or other coupler 84 connects the first and second conduits 78 and 80 together. A conduit fitting 86 is mounted on the end portion of the second conduit 80 from which the first cable 34 extends. Preferably, the first conduit 78 is made from a metal and provides a rigid guide for the first cable 34. The second conduit 80 is formed from an organic polymeric material and is generally flexible to allow for routing of the guide means 32 through a curved path. Alternatively, a single conduit may be used to replace the combination of the first and second conduits 78 and 80, depending upon the environment.

The assembly 10 includes cable return means for automatically returning the first and second cables 34 and 36 to the neutral position after actuation to the actuated position. In other words, once the latches 26 are released by actuation of the first and second cables 34 and 36, the cable return means returns the first and second cables 34 and 36 to the neutral position. Since the latches 26 have disengaged the vent doors 16, the vent doors 16 remain in the opened position to be closed and relatched. As shown in FIG. 2, the return means includes biasing means such as springs 88 operatively connected to the second cable 36 for drawing the first cable 34 out from the actuator means 30 to the neutral position. A tube 90 is disposed about the second cable 36 between each of the end portions 38 thereof and intermediate portions 40. The second cable 36 includes a slug member 92 fixedly secured thereto and disposed between each of the end portions 38 and the end portion of the tubes 90 and spaced from the end portions of the tubes 90 when the first and second cables are in the neutral position and disposed adjacent to the end portion of the tubes 90 when the first and second cables 34 and 36 are in the actuated position so as to abut against the end portion of the tubes 90.

In operation, if a small fire or other disturbance occurs within the building 14 so as to create smoke, heat or chemical fumes which is not sufficient to break the fuse link but necessitates venting thereof, the actuator means 30 is actuated by turning the crank arm 64. The gearing within the actuator means 30 engages the helical wire 66 disposed around the terminal portion 65 of the first cable 34 so as to draw the first cable 34 through the actuator means 30 and conduits 78 and 80. The terminal portion 65 of the first cable 34 is drawn into the tubing 72, isolating the cable 34 from dust and other contaminants and guiding the terminal portion 65. Actuation of the first cable 34 is translated to the second cable 36 by the coupling means 42 whereby actuation of the second cable 36 moves the links 26 to disengage the doors 16. Thus, the doors 16 are allowed to open by actuation of the spring biased links 18. Once the crank handle 64 of the actuator means 30 is released, the springs 88 which were compressed by the slugs 92 being drawn toward the tubes 90, force the slugs 92 away from the tubes 90 so as to draw the first and second cables 34 and 36 toward the neutral position. Once the building 14 is vented, the vent doors 16 are closed and the latches 26 are moved to the latched position.

The instant invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are not to be in any way limiting, the invention may be practiced otherwise than as specifically described.

The embodiments of the invention in which an exclusive property or privilege is claimed are defined as follows:

1. A motion transmitting remote control assembly of the type for transmitting motion in a curved path to open from a remote location at least one vent door which is held in a closed position by latch means which engages the door, said assembly comprising:

cable means for transmitting linear motion along a curved path;

actuator means for actuating linear motion of said cable means;

guide means for guiding the path of said cable means, said cable means including a portion extending from said guide means and adapted to be operatively connected to said latch means whereby operation of said actuator means actuates linear motion of said cable means to disengage the latch means from the vent door, said cable means including a first cable extending from said actuator means and through said guide means and a second cable having two end portions and an intermediate portion therebetween, each of said end portions of said second cable being adapted to be connected to respective ones of a pair of latch means engaging a pair of adjacent vent doors in a closed position; and coupling means for coupling said first cable to said intermediate portion of said second cable, said coupling means including a passageway therethrough, said intermediate portion of said second cable being disposed within said passageway, said coupling means includes a first and second plate member secured together to clamp a portion of said first cable therebetween, at least one of said first and second plate members having a channel therein forming said passageway when said first and second plate members are secured together.

2. An assembly as set forth in claim 1 wherein said channel is substantially longitudinally arcuate.

3. An assembly as set forth in claim 2 wherein said first and second cables have a neutral position and an actuated position for releasing the latch wherein a terminal portion of said first cable is drawn into said actuator means, said assembly including cable return means for returning said first and second cables to said neutral position.

4. An assembly as set forth in claim 3 wherein said return means includes biasing means operatively connected to said second cable for drawing said first cable out from said actuator means to said neutral position.

5. An assembly as set forth in claim 4 including a tube disposed about said second cable between each of said end portions thereof and said intermediate portion, said tube having an end portion, said second cable including a slug member fixedly secured thereto and disposed between each of said end portions of said second cable and said end portion of said tubes and spaced from said end portion of said tubes when said first and second cables are in said neutral position and disposed adjacent said end portion of said tubes when said first and second cables are in said actuated position, said biasing means including a spring disposed between each of said slugs and said end portions of said tubes.

6. An assembly as set forth in claim 5 wherein said actuator means includes a crank actuated drive member having peripheral grooves therein, said first cable including a terminal portion including a core element having a helical wire wound thereabout engaging said grooves whereby rotary motion of said crank arm is translated into linear motion of said first cable.

7. An assembly as set forth in claim 6 wherein said terminal portion of said first cable includes stop means for preventing said terminal portion from being completely fed through said drive member by said cable return means.

8. An assembly as set forth in claim 7 wherein said actuator means includes a housing enclosing said actuator means, said housing including abutment means for engaging said stop means to prevent said stop means from entering said housing.

9. An assembly as set forth in claim 8 wherein said stop means includes a plug member fixedly secured to said terminal portion of said first cable.

10. An assembly as set forth in claim 7 wherein said housing includes a tubular extension for allowing said terminal portion to enter into said tubular extension when said first and second cables are actuated to said actuated position.

11. An assembly as set forth in claim 7 wherein said guide means includes a conduit having two ends, one of said ends being connected to said actuator means, said first cable extending from said actuator means and through said conduit and out of the other of said ends of said conduit.

12. An assembly as set forth in claim 1 wherein said actuator means includes a crank actuated drive member having peripheral grooves therein, said cable means including a terminal portion including a core element having a helical wire wound thereabout engaging said grooves whereby rotary motion of said crank arm is translated into linear motion of said cable means.

13. An assembly as set forth in claim 12 wherein said terminal portion of said cable means includes stop means for preventing said terminal portion of said cable means from being completely fed through said drive member.

14. An assembly as set forth in claim 13 wherein said actuator means includes a housing enclosing said actuator means, said housing including abutment means for engaging said stop means to prevent said stop means from entering said housing.

15. An assembly as set forth in claim 14 wherein said stop means includes a plug member fixedly secured to said first end portion of said cable means.

16. An assembly as set forth in claim 13 wherein said housing includes a tubular extension for allowing said terminal portion to enter into said tubular extension when said first and second cables are actuated to said actuated position.

17. An assembly as set forth in claim 13 wherein said guide means includes a conduit having two ends, one of said ends being connected to said actuator means, said cable means extending from said actuator means and through said conduit and out of said other end of said conduit.

18. A motion transmitting remote control assembly of the type for transmitting motion in a curved path to open from a remote location at least one vent door which is held in a closed position by latch means which engages the door, said assembly comprising:

cable means for transmitting linear motion along a curved path;

actuator means for actuating linear motion of said cable means;

guide means for guiding the path of said cable means, said cable means including a portion extending from said guide means and adapted to be operatively connected to said latch means whereby operation of said actuator means actuates linear motion of said cable means to disengage the latch means from the vent door, said cable means including a first cable extending from said actuator means and through said guide means and a second cable having two end portions and an intermediate portion therebetween, each of said end portions of said second cable being adapted to be connected to respective ones of a pair of latch means engaging a pair of adjacent vent doors in a closed position; coupling means for coupling said first cable to said intermediate portion of said second cable, said first and second cables having a neutral position and an actuated position for releasing the latch wherein a portion of said first cable is drawn into said actuator means; and cable return means for returning said first and second cables to said neutral position, said cable return means including biasing means operatively connected to said second cable for drawing said first cable out from said actuator means to said neutral position.

19. An assembly as set forth in claim 18 including a tube disposed about said second cable between each of said end portions thereof and said intermediate portion, each of said tubes having an end portion, said second cable including a slug member fixedly secured thereto and disposed between each of said end portions of said second cable and said end portion of said tubes and spaced from said end portion of said tubes when said first and second cables are in said neutral position and disposed adjacent to said end portion of said tubes when said first and second cables are in said actuated position, said biasing means including a spring disposed between each of said slugs and said end portions of said tubes.

20. An assembly as set forth in claim 19 wherein said actuator means includes a crank actuated drive member having peripheral grooves therein, said first cable including a terminal portion including a core element having a helical wire wound thereabout engaging said grooves whereby rotary motion of said crank arm is translated into linear motion of said first cable.

21. An assembly as set forth in claim 20 wherein said terminal portion of said first cable includes stop means for preventing said terminal portion from being completely fed through said drive member by said cable return means.

22. An assembly as set forth in claim 21 wherein said actuator means includes a housing enclosing said actuator means, said housing including abutment means for engaging said stop means to prevent said stop means from entering said housing.

23. An assembly as set forth in claim 22 wherein said stop means includes a plug member fixedly secured to said terminal portion of said first cable.

24. An assembly as set forth in claim 21 wherein said housing includes a tubular extension for allowing said terminal portion to enter into said tubular extension when said first and second cables are actuated to said actuated position.

25. An assembly as set forth in claim 21 wherein said guide means includes a conduit having two ends, one of said ends being connected to said actuator means, said first cable extending from said actuator means and through said conduit and out of said other end of said conduit.

* * * * *